United States Patent [19]

Hong

[11] Patent Number: 4,928,791

[45] Date of Patent: May 29, 1990

[54] ROPE CLIMBER

[76] Inventor: Chie F. Hong, 4F, No. 45, Lane 289, Hsin Tai Road, Hsin Chuang City, Taipei Hsien, Taiwan

[21] Appl. No.: 396,618

[22] Filed: Aug. 22, 1989

[51] Int. Cl.[5] ..... A63B 27/00

[52] U.S. Cl. ..... 182/135; 182/136; 182/100

[58] Field of Search ..... 182/133, 134, 135, 136, 182/189, 190, 193, 100

[56] References Cited

U.S. PATENT DOCUMENTS

| | | | |
|---|---|---|---|
| 213,715 | 3/1879 | Mengden | 182/136 |
| 315,025 | 4/1885 | Heath | 182/135 |
| 493,391 | 3/1893 | Sturtevant | 182/135 |
| 580,794 | 3/1897 | Money | 182/135 |
| 983,335 | 2/1911 | Westad | 182/135 |
| 1,168,321 | 1/1916 | Maley | 182/135 |

FOREIGN PATENT DOCUMENTS

| | | | |
|---|---|---|---|
| 31208 | 9/1926 | France | 182/135 |

*Primary Examiner*—Reinaldo P. Machado
*Attorney, Agent, or Firm*—Wenderoth, Lind & Ponack

[57] ABSTRACT

A rope climber for hanging on a steel cable, a rope or a long pole suspended in the air and operable to enable a person's body to be lifted up or lowered down the cable or rope and to stop at any position on the cable or rope. The rope climber includes a pair of grooved wheels having the outer circumferences in close contact and capable of rotating in opposite directions, one or both of the grooved wheels having at the middle of the outer circumferences eccentric grooves, the grooved wheels defining at the close contact point of the outer circumferences a hole through which the cable or rope passes. By rotation of the grooved wheels the hole can be varied in size, whereby the rope climber is able to slide up and down the cable or rope when the hole is large in size and will hold the cable or rope tightly and stay at any fixed place on the cable or rope when the hole is small.

11 Claims, 3 Drawing Sheets

ROPE CLIMBER

BACKGROUND AND SUMMARY OF THE INVENTION

The present invention relates to a novel rope climber, particularly to a rope climber adapted to be hanged fastenedly on a cable, a rope or a long pole suspending from a high place whereby a person is able to climb up and down by the cable, rope or the pole by operating the climber in an alternating manner with hands and feet and to stay at any position on the cable, rope or the pole Till now, when mankind use a rope for climbing up to a high altitude or for descending they have only to rely on strong physical strength and the manner of using both hands and feet in order to attain their purpose. While their purpose may be only to climb down by the rope, they can not of course stay longer at any high position on the rope. They can not do so for when they have used up their arm strength they will surely be thrown down let alone that they be able to stay on the rope and attend to the job on the rope. For this reason, it has been an urgent need for those working in the tall buildings or on a high altitude if, a kind of rope climbers could be provided which is not only operable by a single person but also enables the person to climb up and down at will and to stay at any position on the rope while freeing both hands to attend to the job with no worries for safety. However, till today, there has not been found an apparatus that can provide such a usage. Besides, when climbing up and down by a rope, because there is a direct rubbing of hand and foot against the rope and the skin is likely torn and bleeds, a person can only proceed with ropes of a soft texture such as a rope made of hemp, jute, flax, etc. which gets rotten and broken off easily and also the strength of which has been something for worry. On the contrary, although the steel cables and ropes are of high strength and ensure higher safety, there still has not had any means to deal with.

Although there are ladders for working at low altitude, these ladders are however beyond their capacity for working at higher altitudes. At the same time even though there are elevators, lifts, scaling ladders for use by those who work at higher altitudes, still these equipments are expensive and usually occupy large area on the ground, and also are not within everybody's reach for installation.

Presently, there are many high-rise buildings in towns and cities, such that demands for working at high altitude are also on the rise daily. In this respect, there is truly a need now for developing a simple and highly safe ascent apparatus, the development of which will require no much of the high technology and also which is operable in use by an average man just after a little practice. It is by this need that an ascent apparatus of the present invention has been developed.

Accordingly, an object of the present invention is to provide a novel rope climber being simple in construction and highly safe, the rope climber further being capable of providing for operation by a single person and requiring no high technical skill nor help of a source of power to enable the person to climb up and down freely by a steel rope or pole suspending from a high altitude and to also stay for attending to the job at any position on the rope.

It is a further object of the present invention to provide a rope climber not only for use for working on the job at high altitude but also as equipment in sports such as mountaineering, cliffclimbing and amusement and in the event of emergency further as life escape means in high-rise buildings.

BRIEF DESCRIPTION OF THE DRAWINGS

The above and other objects and advantages of the invention may be best understood from the following detailed description of the embodiment of the present invention illustrated in the drawings, wherein.

DETAILED DESCRIPTION OF THE PREFERRED EMBODIMENT

Figure 1:
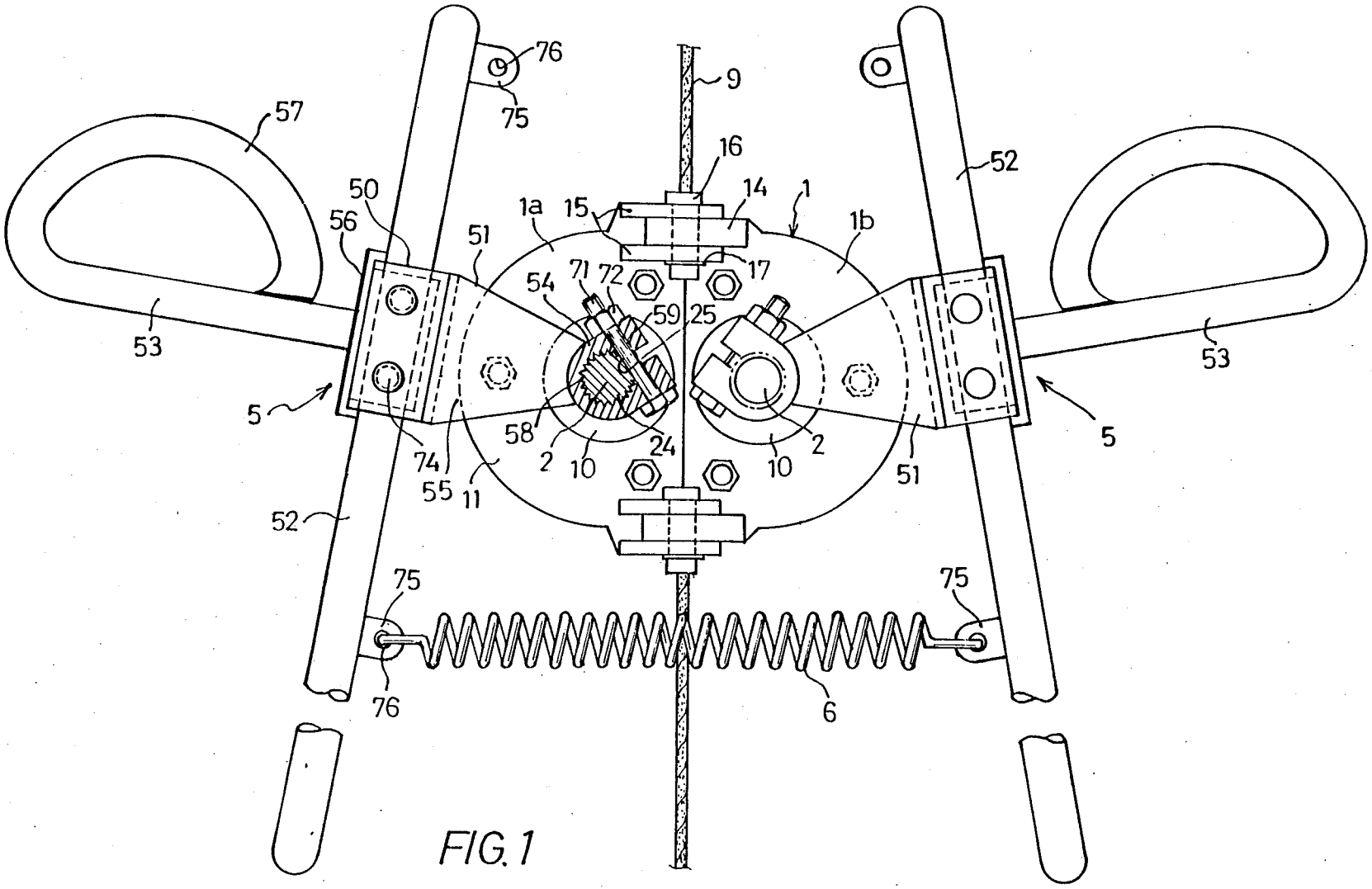
FIG. 1 is a front view of a partial cutaway rope climber embodying principles of the present invention.
Figure 2:
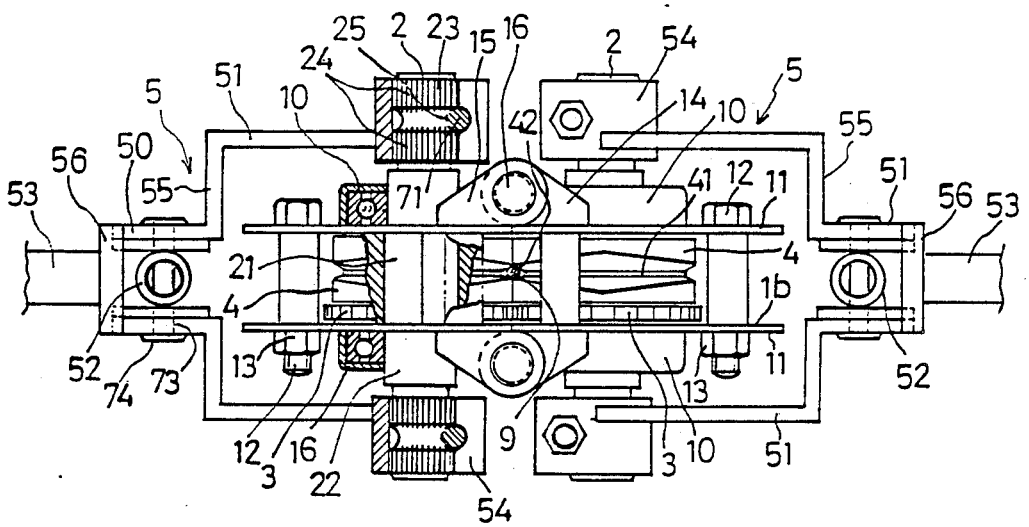
FIG. 2 is a top partially sectional view of the rope climber.
Figure 3:
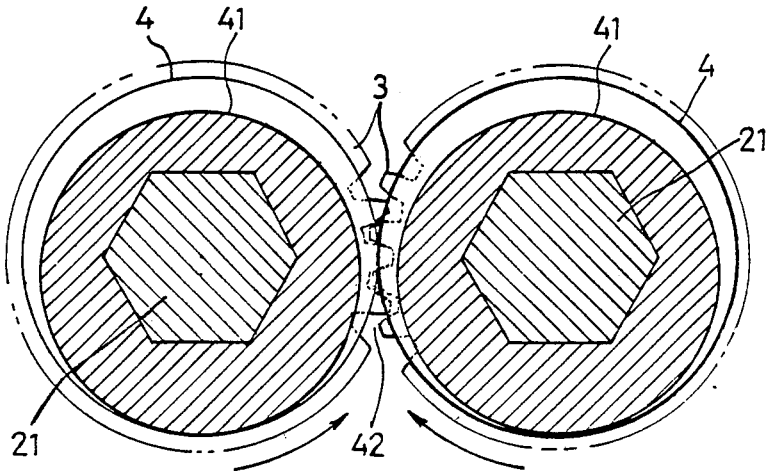
FIG. 3 is a sectional view of the rope climber taken along the line A—A of FIG. 2.

As shown in FIGS. 1 and 2, a rope climber of the present invention comprises a casing 1, a pair of shafts 2 rotatably supported on the casing 1 in a longitudinal parallel manner by bearings 10, a pair of gears 3 respectively fixed on and capable of rotating together with the pair of shafts 2 in a mesh engaging manner, a pair of grooved wheels 4 similarly mounted on and capable of rotating together with the pair of shafts 2, a pair of operating handles 5 firmly mounted on the respective ends of the pair of shafts 2 for operating rotation of the shafts 2 and a tension spring 6 suspendingly disposed between the pair of operating handles 5.

The casing 1 consists of a left and a right half members 1*a*, 1*b* each having a front and a rear side plates 11 maintained at a fixed spacing to be connected together to form a single body by means of screw bolts 12 and nuts 13. The front and the rear side plates 11 are provided respectively at the upper and the lower parts of the connected side thereof with male and female protruding sheets 14, 15 capable of being locked in engagement with each other and acting as pivoting pieces and through pins which pass through the protruding sheets 14, 15 and snap rings 17 being pivotably connected to each other on the upper and the lower parts of the front and the rear sides to thereby enable the two half members 1*a*, 1*b* to be combined as one body.

On the front and the rear sides somewhat in the middle portion of each of the two half members 1*a*, 1*b* in the casing 1 are arranged in a row and oppositely in front and back the bearings 10. Rotatably supported on the two pairs of bearings 10 are the pair of parallel arranged shafts 2 in perpendicular of the front and the rear side plates 11. As shown in FIG. 2, each of these shafts 2 includes in the middle a polygonal portion 21 and immediately adjacent the two ends of this polygonal portion 21 on each side an end portion 23 also engagingly supported on a round shaft 22 in the bearing 10 and having on the surface of the two terminal end portions of the shaft 2 a serrated knurl 24 and an annular groove 25 for locking with a bolt.

Polygonal shaft portions 21 of the two shafts 2 are provided by fitting on the same side shaft portion thereof adjacent the inner wall of the casing 1 with a gear 3 having the corresponding number and size of teeth. The pair of gears 3 are meshed together to rotate synchronously in opposite direction. The polygonal shaft portions 21 are next fitted immediately adjacent the gears 3 thereon with a pair of grooved wheels 4 formed on the outer circumferences thereof with eccentric grooves or cam paths or unequal diameter circular groove 41 with change in diameter from the small to the large. The two grooved wheels 4 are arranged together in a row defining therebetween a hole 42 for rope to pass through. The foregoing gears 3 and grooved wheels 4 are fitted by polygonal holes onto the polygonal shaft portion 21 and are enclosed at the front and the rear by side plates 11 so that both gears 3 and wheels 4 are capable of rotating together with the shaft 2.

The operating devices 5 are formed by assembly of a pair of rodlike components symmetrically connected on the sides to the two ends of the shafts 2 for operating the respective shafts 2 to rotate. These rodlike components comprise essentially two pairs of operating arms 51 each having one end formed in an open-type sleeve 54 and the other end in a curved arm 53, a pair of straight rods 52 being respectively vertically extendible in relation to the operating arms 51 and secured in position within the respective pair of curved arms 55, and a pair of loop rods 53 having one end fixed by the joint 56 thereof to the straight rod connecting ends of the curved arms 55 and the other end formed in an approximately semicircular loop portion 57. It is also possible that if shape of the end of the curved arm 55 which connects the straight rod 52 is somewhat changed so that only one curved arm 55 on each side is utilized and merely fixed in sleeve joint to one end of the shaft 2 by the sleeve 54.

The aforesaid sleeve 54 is provided on the inside with a female tooth part 58 capable of meshing the male tooth part 24 of the shaft 2 and a bolt hole 59 transversely passing through the open end. It is by means of that sleeve 54 being fitted over the end shaft portion 23 of the shaft 2 that the operating arm 51 permits the male and female tooth parts to mesh and the bolt 71 to be tightly locked and firmly fixed on the two end portions of the shaft 2 by nuts 72 after the bolt has been passed through the bolt hole 59. Since there is a portion on the middle section of the bolt 71 passing through the hole 59, which is just engaged in a bolt lock groove 25 of the shaft 2, it is thus possible that the operating arms 51 are positively connected to the shafts 2 and that during operation the sleeves 54 are securely fastened thereon and will not become loose or escape out. Furthermore, it is to be noted that the connecting plate 50 formed at the free end of one curved arm 55 is just opposite to and maintained at a suitable space with the connecting plate 50 of the other curved arm 55, each connecting plate 50 being defined with two rivet holes 73 and by means of rivets 74 passing through the straight rod 52 located in the space between the connecting plates 50 to thereby fix the straight rod 52 to one end of the two operating arms 51. However, for the fixing of the straight rod 52, it is also possible that instead of utilizing the riveting technique with rivets, means such as screws and nuts of welding may be used. The loop operating rod 53 is fixed by welding by a joint 56 at one end thereof to the ends on the side of the connecting plates 50 of the pair of operating arms 51 to seal up the opening between the two connecting plates 50, or the loop rod 53 clamps the straight rod 52 or the connecting plates 50 by forming a joint plate having a U-type section and the three being riveted together by rivets 74 to form a single body, or the joint 56 being fixed by welding directly to one side of the straight rod 52 and joined with the operating arm 51 or the straight rod 52 to form a single body. The straight rod 52 at the jointed end of the operating arms 51 is provided on the upper and lower parts thereof respectively with a lug 75 having a hole 76. Between the lower lugs 75 of the right and left straight rods 52 is suspended a spring 6 constantly pulling the two straight rods 52 towards the inside. For the purpose of safety, between the two loop operating rods 53 is next provided by fastening a safety waist band 8 having in the center a girgle 81 for tying to the waist of the user. With the help of this waist band 8 the user is thus able to stay at any place on the steel cable and attend to the job freely and to prevent falling down by slip of hand during the process of rope climbing. Again, it will also do if a spring leaf disposed between the sleeve 54 and the shaft 2 for holding the straight rod 52 towards the inside is used in substitution for the aforesaid coil spring 6.

The fact that each straight rod 52 has been provided with two lugs is that when using the rope climber of the present invention it is necessary that the equipment be used in pair. When rope climber of the invention in pair is used, the operating handles 5 located at the upper part of the steel cable may act as hand operating ones while the operating handles 5 lying at the lower part may then be used as foot operating ones. Furthermore since the straight rods 52 of the two operating handles 5 can just be used for mounting in an upside-down inverted position, there will be no requirement for making two kinds of straight rods 52.

In the following, a use of the rope climber of the present invention will be described in detail.

Figure 4:
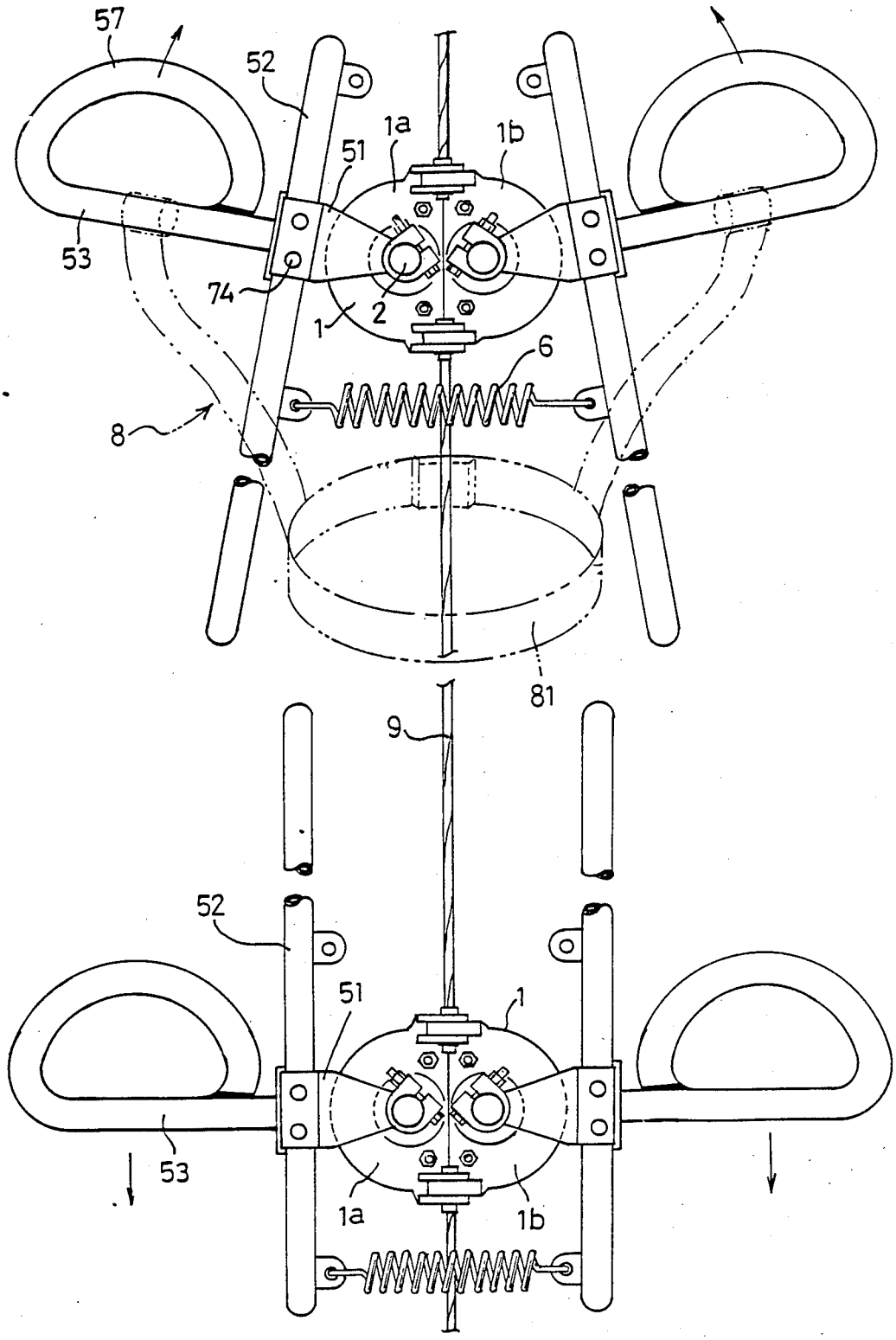
FIG. 4 is a view illustrating the operating condition of the rope climber.

In utilizing this rope climber, it is necessary, as shown in FIG. 4, to use as one unit two sets of the climber to be attached by hanging one above the other to the suspending lower end of a steel cable 9 hanging down on a high altitude or from a tall building. To suspendingly attach a rope climber on, all that one has to do is to allow the suspending lower end of the steel cable to pass through a cable passing hole 42 on the rope climber. Alternatively, it can also be performed by removing out the pin 16 from either side of the casing 1, thereafter with the pin 16 of the other side and the protruding pieces 14, 15 acting as hinge opening out one side of the two half members 1*a*, 1*b*, allowing the steel cable 9 to be clamped between the two grooved wheels 4, closing up the two half members 1*a*, 1*b* and next inserting back the pin 16 to join the two half members as a single body. Following this way, there will be no requirement for one end of the steel cable to pass through the hole 42, but by the casing structure being openable at any time to possibly mount the rope climber to any position on the steel cable or rope for use. Furthermore, by relation of the meshing engagement between the sleeves 54 and the tooth portions of the shaft ends 23 and by complying with thickness of the steel cable or rope 9 to adjust the mounting angel of the grooved wheels 4 with respect to the shafts 2, the relation, location and angle between the operating arms 51 and the shafts 2 and the grooved wheels 4 can be suitably adjusted to facilitate operation for use.

When mounting of the rope climbers has been completed, the user must grib with both hands the loop portions 57 of the operating handles 5, that is, the hand operating ones, on the above and pull the portions downwardly and inwardly. Following the action and through the intermediary of the shafts 2 rotating oppositely and the gradually narrowing hole 42, the steel cable or rope 9 is held tightly in between the two grooved wheels 4, the rope climber on the above stops unmoved at the position and will not slide down on the steel cable. After the rope climber on the above has stayed at the original place, the two feet are moved into the loop portions 57 of the operating handles 5 at the lower part, that is, the foot operating ones, and are lifted upwardly against the pulling force of the spring 6. The two grooved wheels 4 are moved to turn round in the opposite directions enabling the hole 42 originally holding the steel cable or rope 9 tightly in between to become enlarged and thus loosen the cable. Following the raise-up of the two feet the entire rope climber at the lower part becomes lifted up along the steel cable accordingly and when this climber has reached an appropriate position on the cable, the upward movement of the two feet is stopped. Next, by reversing the stepping movement of the operating handles 5 in the inward and downward direction, these operating handles 5 produce a similar effect as the aforesaid hand-operating pair and force the lower rope climber to hold the steel cable 9 in between tightly, such that the person can stand unmoved on said operating handles. While stamping on the foot operating handles, the two hand operating handles 5 are next pushed upward and outward so that the hole 42 on grooved wheels 4 becomes expanded, whereby the upper rope climber begins to rise up by the steel cable by the effect same as during the upward pulling of the aforesaid foot operating handles. When the rope climber has reached an appropriate ascending position on the cable, the foot operating handles are again operated to pull and move the lower rope climber upwardly. In this way, by operating the upper and lower rope climbers alternately by hand and foot, the man's body will thus climb upwardly by the steel cable and when it is desired to descend from the above, this can be accomplished by performing in an alternate way the action as opposed to that during the above described upward climbing movement and thus the person can descend by the steel cable safely. In the descending movement, it can also be performed by operating the straight rods 52 of the rod assembly 5 with hand and foot. Since the user has the waist band 8 fastened to the hand operating handles, he is thus able to stay at any position on the steel cable and attend to the job freely, and also can be prevented from falling down due to a slip of hand.

With a rope climber of the present invention constructed in the way as above described, a user will need only a steel cable or rope or a long pole and a pair of the rope climber, accompanied by simple operation alternate with hand and foot, to be able to ascend and descend by the cable, rope or the pole and to stay at any position on the rope. The equipment is suitable for working on the job at high altitude. In addition, it can also be used as life escape means in high-rise buildings, and is particularly useful in sports such as mountaineering, cliff climbing, race, body exercises and amusement.

While this invention has been described with reference to a certain embodiment, it will be recognized by the skilled in the art that many variables are possible without departing from the spirit and scope of the invention.

I claim:

1. A rope climber hanging fastenedly in pair on a steel cable, a rope or a long pole suspending in the air and by alternating operation by hand and foot enabling a person's body to be lifted up or lowered down by the rope and to stop at any position on the cable or rope, characterized by that said rope climber includes in pair grooved wheels having the outer circumferences in close contact and capable of rotating towards the opposite direction, one or both of said grooved wheels having on the middle of the outer circumferences provided by engraving with cam paths eccentric grooves or ring grooves of unequal diameter, said grooved wheels formed at the close contact point of the outer circumferences with a hole capable of slipping through the above-said cable or rope, and following rotation of said grooved wheels said hole being capable of varying its size, whereby said rope climber is able to slide up and down by the cable or rope when said hole has become large in size and to hold the cable or rope in between tightly and stay at any fixed place on the latter without being concerned about it being slid down when said hole has become small.

2. A rope climber according to claim 1, wherein said grooved wheels are joined by gears of same specification and having same number of teeth and which rotate concurrently with said grooved wheels and through mesh engagement and rotation of said respective gears said grooved wheels being moved to rotate regularly synchronously towards the opposite direction.

3. A rope climber according to claim 2, wherein each set of said grooved wheels and said gears on the respective parallel shaft rotates synchronously with said shaft in one body.

4. A rope climber according to claim 3, wherein each of said shafts is supported by a bearing set on a position where said grooved wheels are in close contact with each other.

5. A rope climber according to claim 4, wherein said shaft sets are so adapted that the two sets of said shaft sets are capable of breaking off or joining in combination at any time by a hinge openable casing.

6. A rope climber according to claim 4, wherein one end or both ends of said shafts which extend out of said bearings are fitted over with operating handles.

7. A rope climber according to claim 6, wherein said operating handles are fitted tightly on the two sides in a symmetrical manner to the terminal ends of said shafts and are operable by hands or legs to actuate said grooved wheels to press tight or loosen the cable or rope.

8. A rope climber according to claim 1, including in said pair a hand operating unit and a foot operating unit to form a set and where by alternating operation of which enables a person's body to move on the cable or rope.

9. A rope climber according to claim 8, wherein said operating handles are further provided with a safety waist belt for fastening to a person's body so that the person is able to attend to job with hands freely on the suspending cable or rope and prevent the body from falling down for a slip of hand during the ascending operation process.

10. A rope climber according to claim 1, comprising:

a casing having a front and a rear wall plates arranged spaced apart in front and back, a pair of shafts capable of rotating by means of bearings and supported horizontally on the inside of said casing, a pair of grooved wheels fitted over said pair of shafts to be capable of rotating integrally with said shafts and formed on the outer circumferences thereof with cam paths, eccentric grooves or ring grooves of unequal diameter proceeding from the shallow to the more deep in the groove bottom, a pair of gears similarly fitted over the two said shafts closely adjacent the said pair of grooved wheels to be mesh engaged with one another and rotatable along with said shafts, a pair of operating handles symmetrically mounted on one or both ends of said shafts for operating rotation of said shafts and spring means for providing said pair of operating handles with inward withdrawing power.

11. A method of utilizing the rope climber according to claim 1 or 10, including in hanging fastenedly said rope climber in pair on a cable, a rope or a long pole suspending in the air and operating the same in alternate manner with hands and feet to enable a person to climb up and down by the cable, rope or long pole and to stop at any position on the rope.

* * * * *